US007345663B2

(12) United States Patent
Kobayashi

(10) Patent No.: US 7,345,663 B2
(45) Date of Patent: Mar. 18, 2008

(54) PIXEL OVERDRIVE FOR AN LCD PANEL WITH A VERY SLOW RESPONSE (STICKY) PIXEL

(75) Inventor: Osamu Kobayashi, Los Altos, CA (US)

(73) Assignee: Genesis Microchip Inc., Santa Clara, CA (US)

( * ) Notice: Subject to any disclaimer, the term of this patent is extended or adjusted under 35 U.S.C. 154(b) by 446 days.

(21) Appl. No.: 11/105,200

(22) Filed: Apr. 12, 2005

(65) Prior Publication Data

US 2005/0280641 A1 Dec. 22, 2005

Related U.S. Application Data

(60) Provisional application No. 60/562,109, filed on Apr. 13, 2004.

(51) Int. Cl.
*G09G 3/36* (2006.01)

(52) U.S. Cl. ..... 345/87; 345/89

(58) Field of Classification Search ..... 345/87, 345/89–100

See application file for complete search history.

(56) References Cited

U.S. PATENT DOCUMENTS 5,944,801 A * 8/1999 Gulick ..... 710/29
2003/0006949 A1* 1/2003 Sekiya et al. ..... 345/87

FOREIGN PATENT DOCUMENTS

EP 1 467 346 A2 10/2004
JP 2001034238 A * 2/2001
WO WO 94/09475 4/1994

OTHER PUBLICATIONS

International Search Report dated Apr. 12, 2005 from corresponding International Application No. PCT/US2005/012495.

* cited by examiner

*Primary Examiner*—Alexander Eisen
*Assistant Examiner*—Christopher E. Leiby
(74) *Attorney, Agent, or Firm*—Beyer Weaver LLP

(57) ABSTRACT

A memory efficient providing LC overdrive for sticky pixels at a frame n−1 for a current frame n based upon sticky pixel data associated with a frame n−2.

15 Claims, 7 Drawing Sheets

OVERDRIVE TABLE

| | 0 | 32 | 64 | 96 | 128 | 160 | 192 | 224 | 255 |
|---|---|---|---|---|---|---|---|---|---|
| 0 | 0 | -20 | -38 | -55 | -75 | -100 | -126 | -149 | -167 |
| 32 | 80 | 32 | -6 | -23 | -43 | -68 | -94 | -117 | -135 |
| 64 | 153 | 120 | 64 | 21 | -11 | -36 | -62 | -85 | -103 |
| 96 | 194 | 174 | 141 | 96 | 46 | -4 | -30 | -53 | -71 |
| 128 | 229 | 214 | 195 | 167 | 128 | 72 | 5 | -21 | -39 |
| 160 | 259 | 250 | 236 | 217 | 192 | 160 | 92 | 31 | -7 |
| 192 | 291 | 282 | 275 | 264 | 247 | 226 | 192 | 149 | 94 |
| 224 | 323 | 314 | 307 | 296 | 281 | 270 | 255 | 224 | 195 |
| 255 | 354 | 345 | 338 | 327 | 312 | 301 | 286 | 270 | 255 |

FIG. 1

PIXEL OVERDRIVE FOR AN LCD PANEL WITH A VERY SLOW RESPONSE (STICKY) PIXEL

RELATED APPLICATIONS

This patent application takes priority under 35 U.S.C. 119(e) to (i) U.S. Provisional Patent Application No.: 60/562,109 filed on Apr. 13, 2004 entitled "OVERDRIVE ALGORITHM FOR AN LCD PANEL THAT HAS A VERY SLOW (STICKY) PIXEL VALUE REGION" by Kobayashi which is incorporated by reference in its entirety.

BACKGROUND

I. Field of the Invention

The invention relates to display devices. More specifically, the invention describes a method and apparatus for enhancing the appearance of motion on an LCD panel display.

II. Overview

Each pixel of an LCD panel can be directed to assume a luminance value discretized to the standard set [0, 1, 2, . . . , 255] where a triplet of such pixels provides the R, G, and B components that make up an arbitrary color which is updated each frame time, typically $1/60^{th}$ of a second. The problem with LCD pixels is that they respond sluggishly to an input command in that the pixels arrive at their target values only after some noticeable time delay (as long as after several frames on certain panels), and the resulting display artifacts—"smearing" images of rapidly moving objects—are disconcerting. Smearing occurs when the response speed of the LCD is not fast enough to keep up with the frame rate. In this case, the transition from one pixel value to another cannot be attained within the desired time frame since LCDs rely on the ability of the liquid crystal to orient itself under the influence of an electric field. Therefore, since the liquid crystal must physically move in order to change intensity, the viscous nature of the liquid crystal material itself contributes to the appearance of smearing artifacts.

In order to reduce and/or eliminate this deterioration in image quality, the LC response time is reduced by overdriving the pixel values such that a target pixel value is reached, or almost reached, within a single frame period. In particular, by biasing the input voltage of a given pixel to an overdriven pixel value that exceeds the target pixel value for the current frame, the transition between the starting pixel value and target pixel value is accelerated in such a way that the pixel is driven to the target brightness level within the designated frame period. However, some LCD panels exhibit especially slow pixel response times for a specific range of pixel values and are as a result referred to as "sticky" pixels. These sticky pixels are of particular concern since their pixel response times are much longer than the pixel response times for pixel values not in this sticky range.

Therefore, what is required is a method, system, and apparatus for providing an enhanced pixel overdrive only for those pixels identified as sticky pixels that exhibit a very slow pixel response in the sticky range.

SUMMARY OF THE DISCLOSURE

What is provided is a reduced memory method, apparatus, and system suitable for implementation in Liquid Crystal Display (LCDs) that reduces a pixel element response time thereby enabling the display of high quality fast motion images thereupon.

In one embodiment, a method of selectively providing LC overdrive is described. The method is carried out by determining if either a start or a target pixel value for a current video frame n is within a sticky pixel value range and based upon a sticky pixel indicator value for a video frame n−2 ($ST_{n-2}$), an output pixel value associated with a previous video frame n−1 ($OPD_{n-1}$) is calculated. The output pixel value associated with a previous video frame n−1 ($OPD_{n-1}$) is then applied during the previous video frame n−1 thereby providing a headstart to an LCD overdrive pixel value applied at a current frame n.

In another embodiment, computer program product for providing LC overdrive for sticky pixels is described.

BRIEF DESCRIPTION OF THE DRAWINGS

FIG. 1 shows an exemplary overdrive table.

DETAILED DESCRIPTION OF SELECTED EMBODIMENTS

Reference will now be made in detail to a particular embodiment of the invention an example of which is illustrated in the accompanying drawings. While the invention will be described in conjunction with the particular embodiment, it will be understood that it is not intended to limit the invention to the described embodiment. To the contrary, it is intended to cover alternatives, modifications, and equivalents as may be included within the spirit and scope of the invention as defined by the appended claims.

Certain LCD panels exhibit pixel response times that vary substantially over particular ranges of pixel values. Commonly referred to as sticky pixels, these very slow pixels require a different approach than is provided using conventional LCD overdrive in that by providing a "headstart" pixel value to a previous video frame, an LCD overdrive command value for a current video has a much greater likelihood of enabling the pixel to achieve the target pixel value in the allocated frame period. Using the described approach, a memory efficient system, method and apparatus is provided that identifies those situations where the headstart pixel value is required for a previous frame (n−1) based upon sticky pixel data associated with another previous video frame (n−2) in order to enable an LCD command value applied at a current video frame (n) to impel the pixel to the target value within the frame period.

Figure 2:
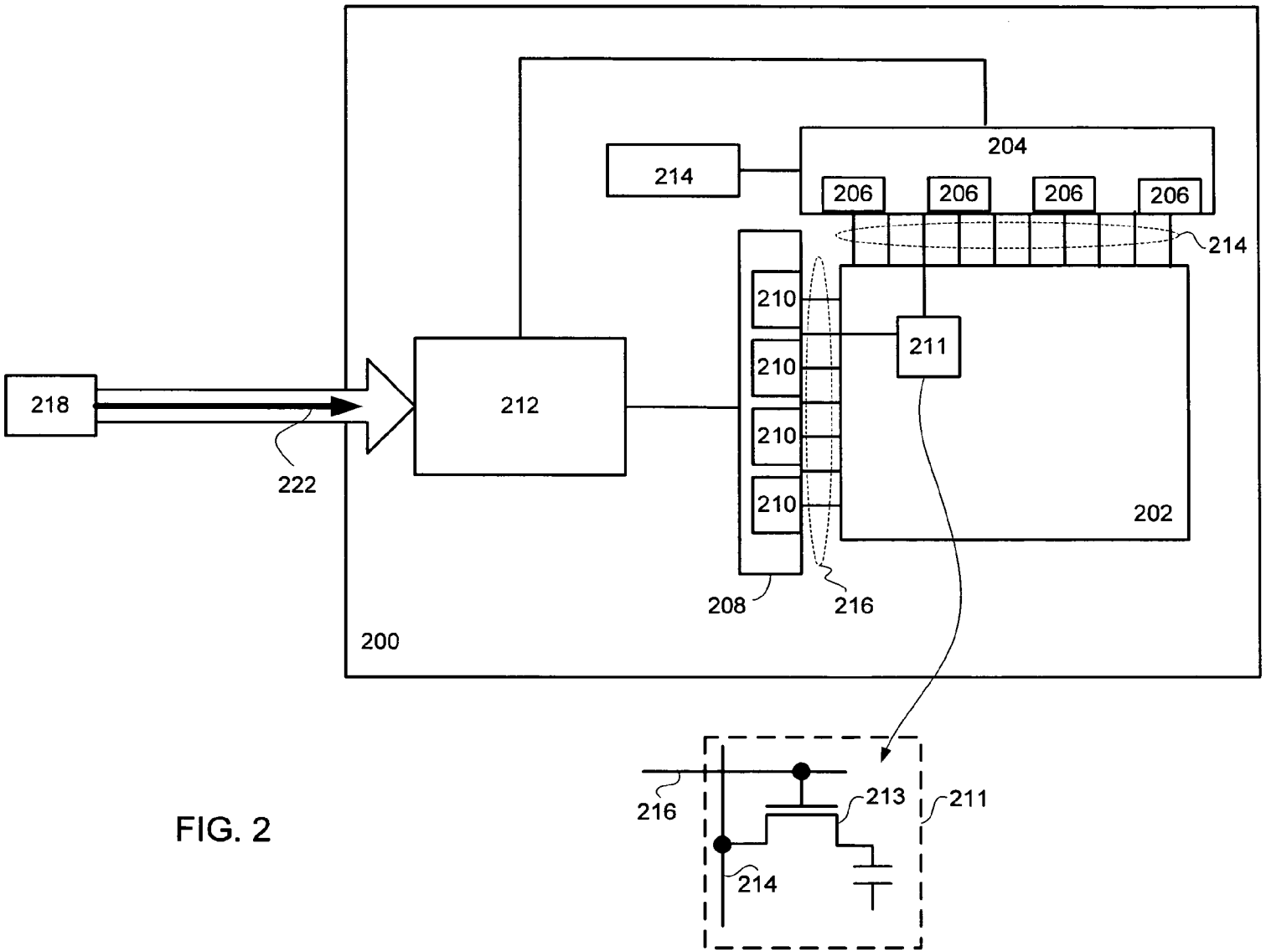
FIG. 2 is a block diagram showing an example of an active matrix liquid crystal display device suitable for use with any embodiment of the invention.

What follows is a brief description of an active matrix LCD panel suitable for use with any embodiment of the invention. Accordingly, FIG. 2 is a block diagram showing an example of an active matrix liquid crystal display device 200 suitable for use with any embodiment of the invention. As shown in FIG. 2, the liquid crystal display device 200 is formed of a liquid crystal display panel 202, a data driver 204 that includes a number of data latches 206 suitable for storing image data, a gate driver 208 that includes gate driver logic circuits 210, a timing controller unit (also referred to as a TCON) 212, and a reference voltage power supply 214 that generates a reference voltage $V_{ref}$ that is applied to the liquid crystal display panel 202 as well as a number of predetermined voltages necessary for operations of the data driver 204 and the gate driver 208.

The LCD panel 202 includes a number of picture elements 211 that are arranged in a matrix connected to the data driver 204 by way of a plurality of data bus lines 214 and a plurality of gate bus lines 216. In the described embodiment, these picture elements take the form of a plurality of thin film transistors (TFTs) 213 that are connected between the data bus lines 214 and the gate bus lines 216. During operation, the data driver 204 outputs data signals (display data) to the data bus lines 214 while the gate driver 208 outputs a predetermined scanning signal to the gate bus lines 216 in sequence at timings which are in sync with a horizontal synchronizing signal. In this way, the TFTs 213 are turned ON when the predetermined scanning signal is supplied to the gate bus lines 216 to transmit the data signals, which are supplied to the data bus lines 214 and ultimately to selected ones of the picture elements 211.

Typically, the TCON 212 is connected to a video source 218 (such as a personal computer, TV or other such device) suitably arranged to output a video signal (and, in most cases, an associated audio signal). The video signal can have any number and type of well-known formats, such as composite, serial digital, parallel digital, RGB, or consumer digital video. When the video signal takes the form of an analog video signal, then the video source 218 includes some form of an analog video source such as for example, an analog television, still camera, analog VCR, DVD player, camcorder, laser disk player, TV tuner, set top box (with satellite DSS or cable signal) and the like. In those cases where the video signal is a digital video signal, then the video source 218 includes a digital image source such as for example a digital television (DTV), digital still camera or video camera, and the like. The digital video signal can be any number and type of well known digital formats such as, SMPTE 274M-1995 (1920×1080 resolution, progressive or interlaced scan), SMPTE 296M-1997 (1280×720 resolution, progressive scan), as well as standard 480 progressive scan video.

Typically, the video signal provided by the video source 218 is taken to be a digital video signal consistent with what is referred to as RGB color space. As well known in the art, the video signals RGB are three digital signals (referred to as "RGB signal" hereinafter) formed of an "R" signal indicating a red luminance, a "G" signal indicating a green luminance, and a "B" signal indicating a blue luminance. The number of data bits associated with each constituent signal (referred to as the bit number) of the RGB signal is often set to 8 bit, for a total of 24 bits but, of course, can be any number of bits deemed appropriate.

Figure 3:
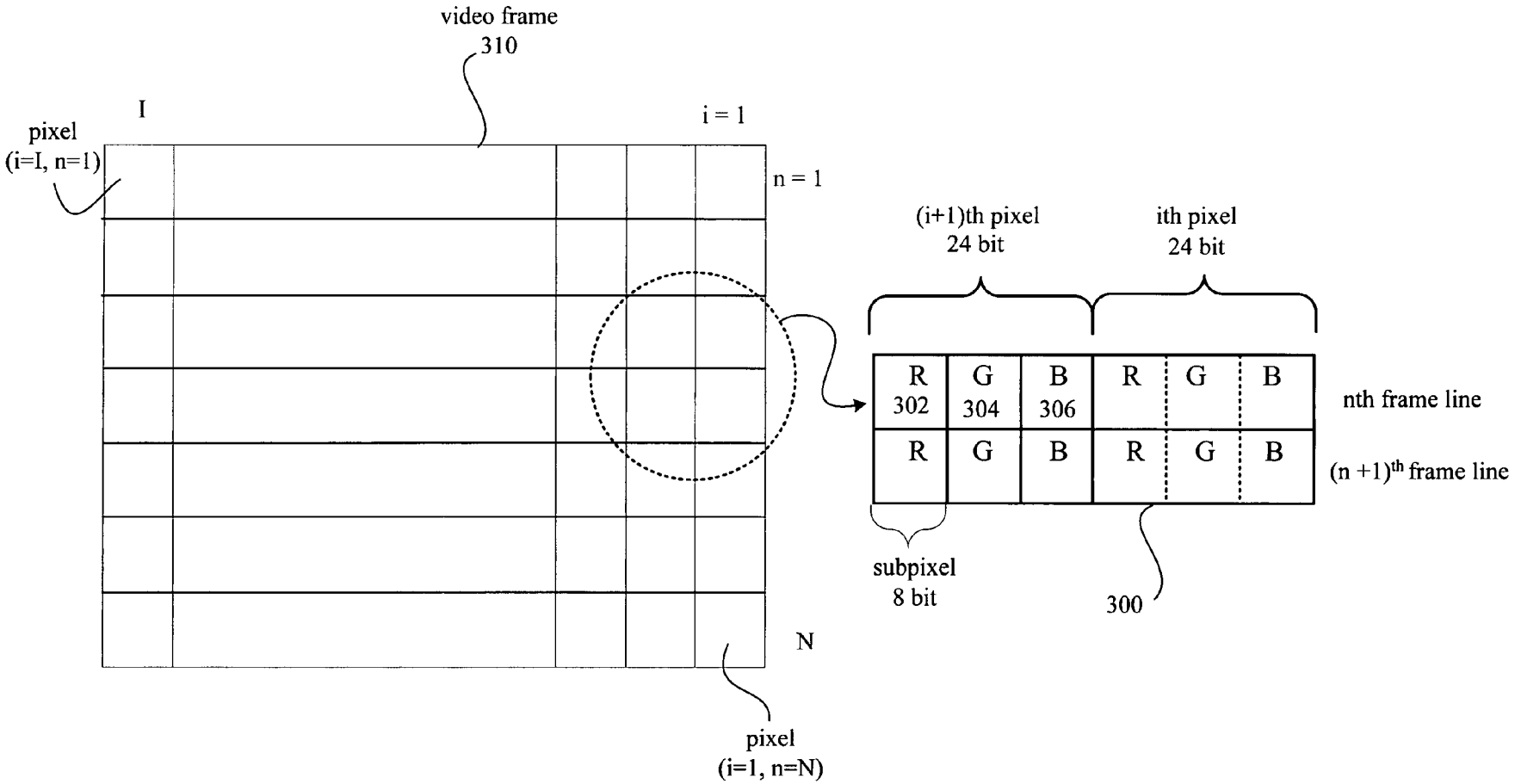
FIG. 3 shows a representative pixel data.

For the remainder of this discussion, it will be assumed that the video signal provided by the video source 218 is digital in nature formed of a number of pixel data words each of which provides data for a particular pixel element. For this discussion, it will be assumed that each pixel data word includes 8 bits of data corresponding to a particular one of the color channels (i.e., Red, Blue, or Green). Accordingly, FIG. 3 shows a representative pixel data word 300 in accordance with the invention. The pixel data word 300 is shown suitable for an RGB based 24 bit (i.e., each color space component R, G, or B, is 8 bits) system. It should be noted, however, that although an RGB based system is used in the subsequent discussion, the invention is well suited for any appropriate color space. Accordingly, the pixel data word 300 is formed of 3 sub-pixels, a Red (R) sub-pixel 302, a Green (G) sub-pixel 304, and a Blue (B) sub-pixel 306 each sub-pixel being 8 bits long for a total of 24 bits. In this way, each sub-pixel is capable of generating $2^8$ (i.e., 256) voltage levels referred to hereinafter as pixel values. For example, the B sub-pixel 306 can be used to represent 256 levels of the color blue by varying the transparency of the liquid crystal which modulates the amount of light passing through an associated blue mask whereas the G sub-pixel 304 can be used to represent 256 levels of the color green in substantially the same manner. It is for this reason that conventionally configured display monitors are structured in such a way that each display pixel is formed in fact of the 3 sub-pixels 302-306 which taken together form approximately 16 million displayable colors. Using an active matrix display, for example, a video frame 310 having N frame lines each of which is formed of I pixels, a particular pixel data word can be identified by denoting a frame line number n (from 1 to N) and a pixel number i (from 1 to I).

Referring back to FIG. 2, during the transmission of a video image in the form of a video frame, the video source 218 provides a data stream 222 formed of a number of pixel data words 300. The pixel data words 300 are then received and processed by the TCON 212 in such a way that all the video data (in the form of pixel data) used for the display of a particular frame line n of the video frame 310 must be provided to the data latches 206 within a line period $\tau$. Therefore, once each data latch 206 has a corresponding pixel data stored therein, is the data driver 204 is selected in such a way to drive appropriate ones of the TFTs 213 in the LCD array 202.

In order to improve the performance of slow LCD panels, the performance of the LCD panel is first characterized by, for example, taking a series of measurements that show what each pixel will do by the end of one frame time. Such measurements are taken for a representative pixel (or pixels) each being initially at a starting pixel value s that is then commanded toward a target value t (where s and t each take on integer values from 0 to 255). If the pixel value actually attained in one frame time is p, then $$p=f_s(t) \tag{1}$$

where $f_s$ is the one-frame pixel-response function corresponding to a fixed start-pixel s. For example, the one-frame pixel response function $f_s(t)$ for a pixel having a start pixel value s=32 and a target pixel value t=192 that can only reach a pixel brightness level of p=100 is represented as $f_{32}(192)=100$.

For slow panels (where most if not all targets can not be reached within a frame time) functions m(s) and M(s) give the minimum pixel value and maximum pixel value, respectively, reachable in one frame time as functions of s that define maximum-effort curves. Therefore, in order to reach a pixel value p that lies within the interval [m(s), M(s)], equation (1) is solved for the argument that produces pixel value p referred to as the overdrive pixel value that will achieve the goal (i.e., pixel value p) in one frame time.

Figure 4:
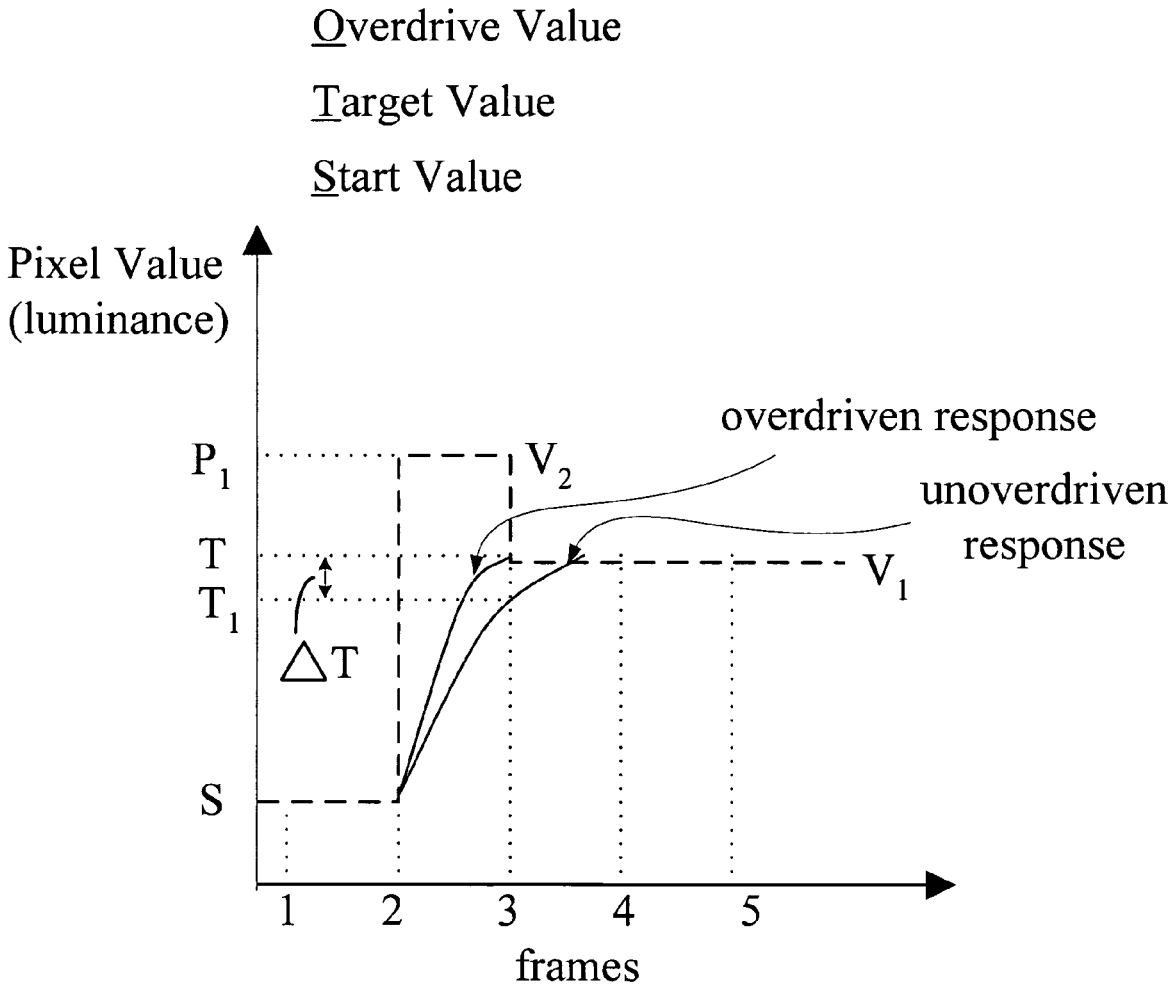
FIG. 4 shows a comparison between an unoverdriven pixel response curve and an overdriven pixel response curve.

For example, FIG. 4 shows a comparison between an unoverdriven pixel response curve and an overdriven pixel response curve in accordance with an embodiment of the invention. In the example shown in FIG. 4, the pixel in question has a start pixel value S at the beginning of a frame 2 and a target pixel value T at the beginning of a next frame 3. However, when the pixel is not overdriven (i.e., a voltage $V_1$ is applied consistent with the target pixel value T), the pixel value achieved $T_1$ falls short of the target pixel value T by a value ΔT resulting in a ghosting artifact in subsequent frames. However, when the pixel is overdriven by applying a voltage $V_2>V_1$ consistent with an overdriven pixel value $p_1$, the target pixel value T is reached within the frame period 2 thereby eliminating any ghosting artifacts in subsequent frames.

It should be noted that the overdrive method requires a timely and accurate characterization of the LCD panel's optical response. An accurate model allows the overdrive to more accurately predict the response of a given pixel to an applied pixel value thereby allowing a more accurate selection of overdriven value and predicted pixel values. Since LCD panel response is affected by temperature, a long warm up time was used in order to ensure that the optical responses generated through this procedure were consistent. LCD optical response is temperature dependent. This is the case since the viscosity of the liquid crystal material is also dependent on temperature. The liquid crystals must physically rotate and thus its viscosity determines how quickly this rotation can take place. It is the speed of this rotation that determines the response time of a given LCD panel. In general, as the temperature increases, the viscosity of the liquid crystal decreases, thus decreasing the optical response time.

Using any of a number of non-inertial approaches (i.e., one that ignores pixel velocity) it is possible to create what is referred to as a Full Overdrive Table (FOT) that shows, for each starting pixel and each target pixel, the command pixel that will most-likely cause the target pixel value to be achieved at the end of one frame time. In the described embodiment, the FOT is formed of a lookup table with 256 columns—one for each starting pixel in the range 0 to 255—and likewise 256 rows, one for each possible target. While the FOT solves the runtime problem by simple lookup, it isn't practical to store a table of that size (256×256). However, by sub-sampling the pixel array at every $32^{nd}$ pixel, for example, using a reference sequence:

$$\text{pix}=\{0, 32, 64, 96, 128, 160, 192, 224, 255\} \tag{2}$$

in which the last entry is truncated to 255, a smaller 9×9 array referred to as an extended overdrive table (EOT) that uses the saturation regions to store useful data is formed. In this way, the extended overdrive table reduces the size of any interpolation errors when straddling crossover points to acceptable levels without requiring storing or using any crossover data. FIG. 1 shows an exemplary overdrive table 100 configured in such a way that a start pixel is given by column j and a target pixel by row i. It should be noted that the overdrive table 100 is provides is a sub-sampled overdrive table having a reduced number of table entries in order to preserve both computational and memory resources. Accordingly, the table 100 provides only those data points that result from "sub-sampling" of a full overdrive table (not shown) having 256×256 entries, one for each combination of start and target pixel. Since the table 100 is based upon a 32-pixel-wide grid (i.e., {0, 32, 64, 96, 128, 160, 192, 224, 255}), there are a number of "missing" rows and columns corresponding to the data points that fall outside of the sampling grid that are estimated at runtime based on any of a number of well known interpolation schemes.

Accordingly, the overdrive function corresponding to the overdrive table (such as that shown in FIG. 1) for fixed start pixel s is given as equation (3), $$G_s(p) = \begin{cases} p - m(s), & p < m(s) \\ f_s^{-1}(p), & m(s) \le p \le M(s) \\ 255 + (p - M(s)), & p > M(s) \end{cases} \tag{3}$$

where the difference δ(p)=p−M(s) is a measure of the shortfall from the target pixel p; referred to as a deficit δ(p). There is no deficit (δ=0) in the unsaturated region, but the deficit becomes positive and grows by one pixel for each pixel further that the target p proceeds past the maximum M(s). In the EOT, the deficit is added to the saturation value of 255. At the low end the deficit is negative: then the deficit δ(p)=p−m(s) to again reflect the idea that the deficit is the difference between what we the target pixel value and the achieved pixel value, only here the target p is smaller than the minimum achieved. Accordingly, the deficit is added to the saturation value, which in this case is 0.

Figure 5:
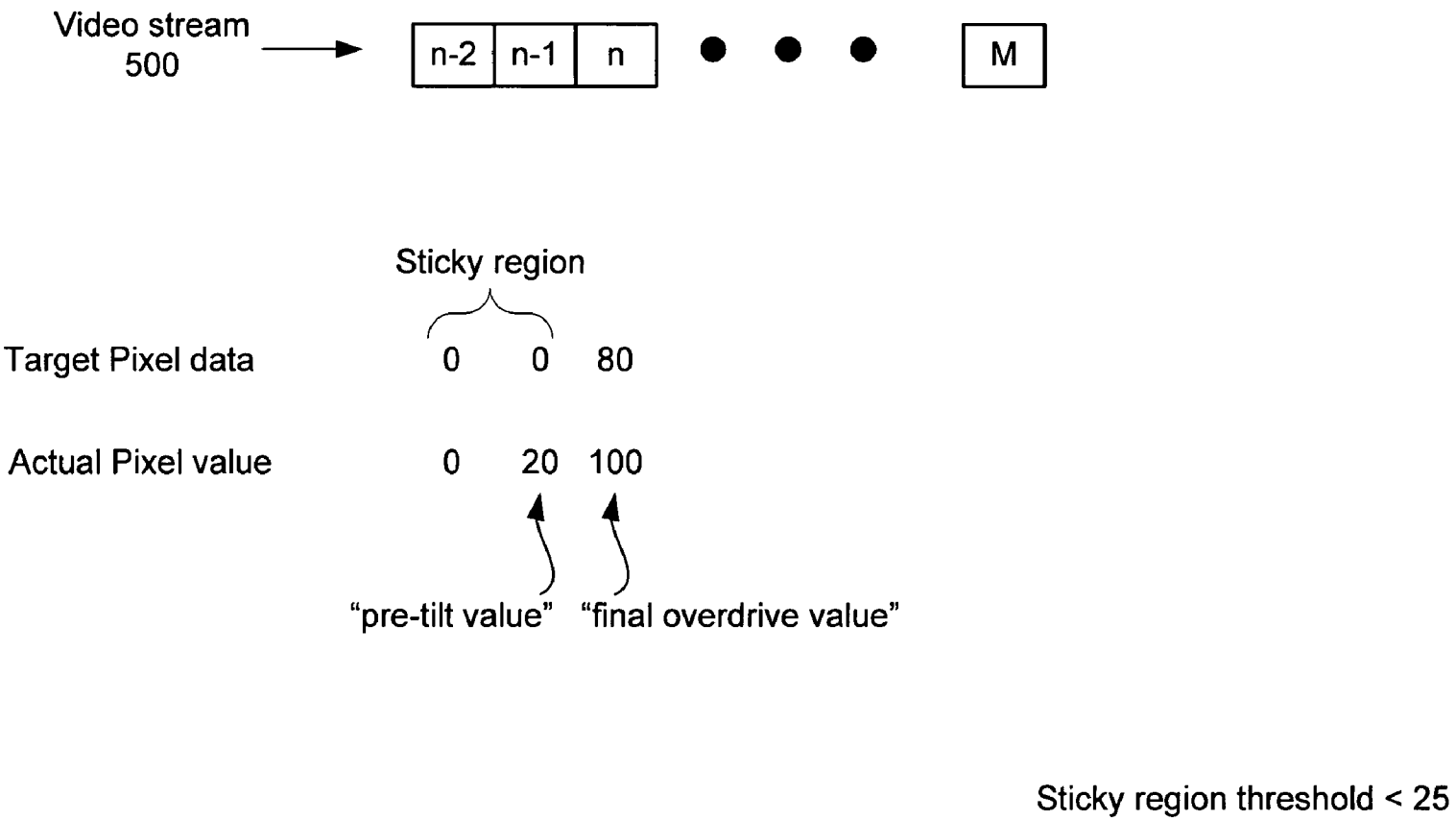
FIG. 5 shows an exemplary video stream.

Of particular concern are those pixels (referred to as sticky pixels) whose response times are substantially slower in a particular range of pixel values. For example, FIG. 5 shows an exemplary video stream 500 formed of M video data packets each being associated with a particular target pixel value. Note, in the example of FIG. 5, the particular LCD panel has been characterized to have a number of pixels that exhibit very slow response for a particular range of pixel values (i.e., a sticky region). In this example, the sticky region includes pixel values between about 0 and 25 where the pixel response time is substantially slower than exhibited for pixel values outside of the sticky region. In this example, the video frames n−2, n−1, and n each have target pixel values of 0*, 0*, and 80, respectively (where * denotes a pixel value within the sticky pixel region). Therefore, the transition from frame n−1 to frame n requires that at least of portion of the transition between frame n−1 and frame n is within the sticky pixel region and therefore will exhibit a substantially slower pixel response time than if the pixel values were not within the sticky pixel region.

For a point of comparison, the command pixel values using a conventional LCD overdrive approach is shown where frame n−1 has a pixel value of 0 and frame n has a pixel value of 100 (in order to reach the target pixel value 80 within one frame period). However, due to the very slow response time of the pixel in the sticky pixel region (i.e., during the transition from pixel value 0 to pixel value 25 on the way to the pixel value of 100), the actual pixel value achieved will be substantially less than 80 due to the initial slow response. Therefore, by using a pre-tilt LCD overdrive approach, the pixel is given a "headstart" in that a pre-tilt pixel value is applied during frame n−1 in anticipation of providing a headstart to the applied pixel overdrive value applied during frame n. In the example shown, a pixel value of 20 is applied at to the pixel at frame n−1 such that the amount of time that the pixel spends in the sticky region (i.e., pixel values less than about 25) is substantially reduced thereby providing the pixel a greater opportunity to reach the target pixel value of 80 during the frame n.

Therefore, as long as the sticky pixel has a start or a target pixel value outside of the sticky pixel value range, the sticky pixel responds to an overdrive voltage as would a non-sticky pixel. However, due to the particular physical characteristics of the sticky pixel, when either or both the start pixel value and/or target pixel value are in the sticky pixel value range, the sticky pixel response time is substantially slower and therefore can not reach the target pixel value represented by the overdrive table. Therefore, these sticky pixels must be identified as such and once identified, a determination must be made whether or not either the start and/or target pixel values are within the sticky pixel value range. When identified, the sticky pixel is given the sticky pixel a "headstart" during a previous video frame.

Figure 6:
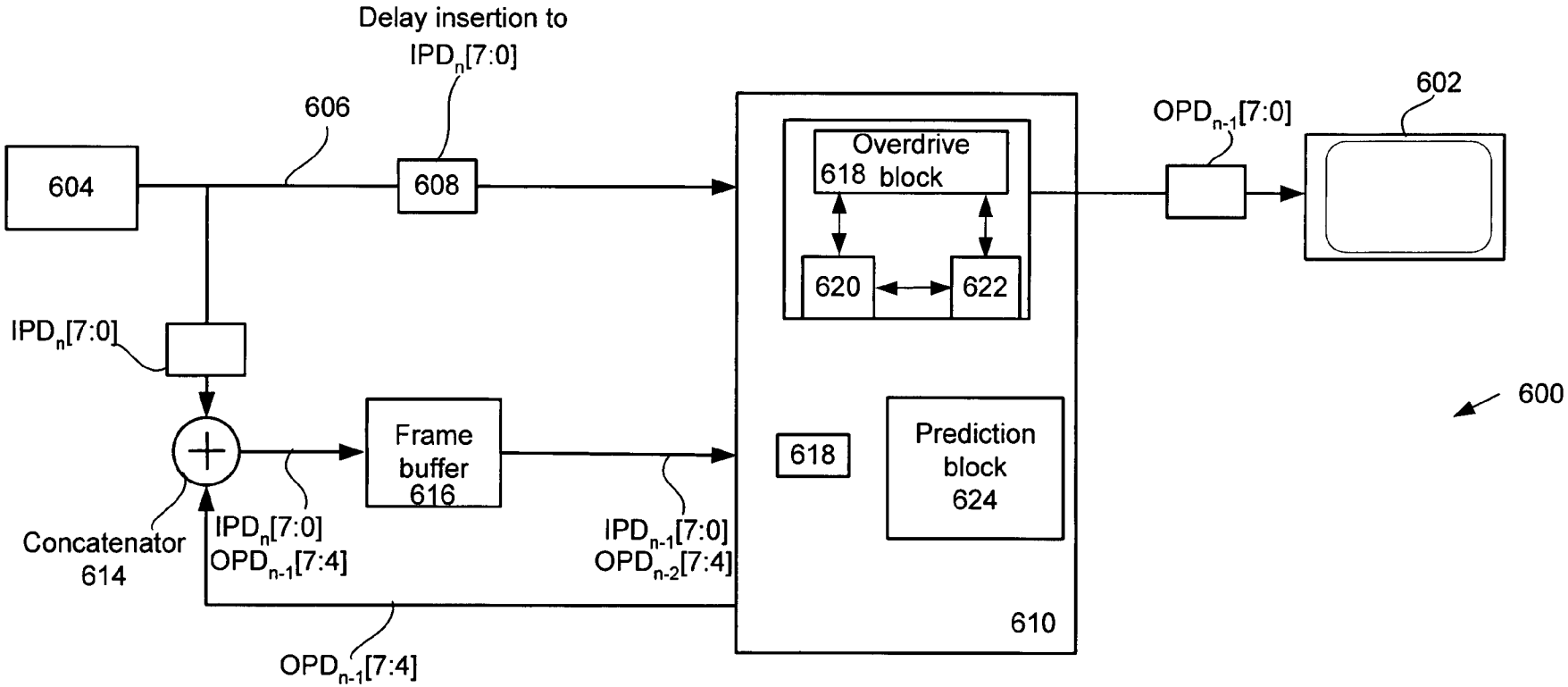
FIG. 6 shows a system in accordance with an embodiment of the invention.

Therefore, FIG. 6 shows a system 600 for displaying a motion enhanced image on an LCD 602 in accordance with an embodiment of the invention. It should be noted, that the system 600 can be used in any number of applications but is most suitable for displaying images prone to exhibiting motion artifacts such as those that include fast motion. The system 600 includes a video source 604 arranged to provide a digital video stream 606 (representative of an arbitrary number M video frames having a current video frame n where n less than or equal to M) formed of a number of data words along the lines described with reference to FIG. 3. As part of the current video frame n, an input pixel dataword IPD 608 is input to an LCD overdrive unit 610. (For sake of simplicity, the following discussion will be limited to a single data channel involving an eight bit data word.) Therefore, the input pixel data IPD 608 for the current video frame n is represented as an eight bit data word $IPD_n[7:0]$. This IPDn[7:0] is also forwarded to a concatenator unit 614. This concatenator unit 614 also receives a pixel value of the last frame OPDn−1, which is currently displayed. The last frame pixel value may be compressed, for example, to 4 bit data, OPDn−1[7:4] through truncation. These two data are concatenated to form a 12-bit data (in this example), IPDn[7:0]|OPDn−1[7:4]. This 12-bit value is written into a frame buffer 616. In parallel to this write, 12-bit data IPDn−1[7:0]|OPDn−2[7:4] are read from the frame buffer 616 to the LCD overdrive unit 610.

A comparator unit 618 compares IPDn−1[7:0] to a sticky region threshold value (which is 25 in the example of FIG. 5) and based upon the result of that comparison, sets the sticky region indicator to "set" (such as a value of "1") when both OPDn−2[7:4] and IPDn−1[7:0] are below the threshold and IPDn[7:0] is above the threshold, or "not set" (such as a value of "0") otherwise. When the sticky region indicator is set, the LCD overdrive unit 610 sets the IPDn−1[7:0] to some value (which is 20 in the example of FIG. 5). In this way, an output pixel data value for the previous frame OPDn−1[7:0] is generated that provides, if necessary, the headstart for the current video frame n. When the sticky region indicator is not set, the overdrive unit 610 uses OPDn−2[7:4] and IPDn−1[7:0] to determine the overdrive pixel value (p).

The overdrive unit 610 includes an overdrive block 618 coupled to an overdrive table 620 and in those cases where the overdrive table 620 is a sub-sampled type overdrive table, an interpolator unit 622 that "reads between the lines" of the overdrive table 620 provides the requisite overdrive pixel value (p) associated with the overdrive pixel applied during the current frame n when one or the other of the values of a start pixel value (s) associated with a previous video frame and a target pixel value (t) associated with the current video frame are not one of the enumerated overdrive table pixel values.

A prediction block 624 is used to generate a predicted pixel value (pv) that calculates the actual brightness of the overdriven video frame based upon the overdriven pixel value (p) that is displayed by the LCD 602. In this way, any errors in the observed brightness level that can become a problem when a given target value (t) is not obtainable in one frame can be eliminated. Since the prediction block 624 effectively predicts the amount of any overshoot that occurs in the overdrive pixel value (p), the starting value of the subsequent video frame start value(s) can be adjusted accordingly. In this way, any overshoot can then be corrected in the subsequent video frame.

Figure 7:
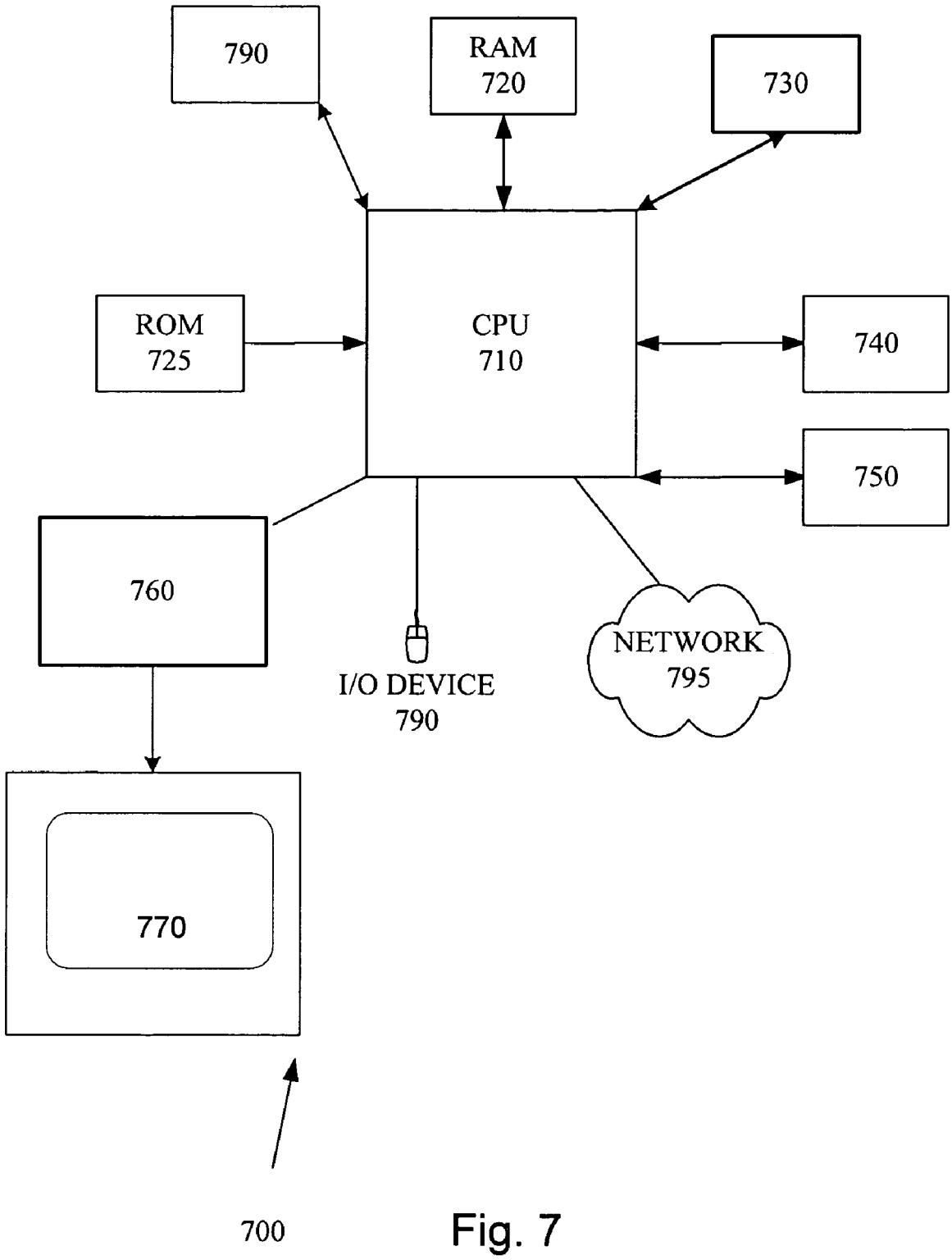
FIG. 7 illustrates a computing system employed to implement the invention.

FIG. 7 illustrates a system 700 employed to implement the invention. Computer system 700 is only an example of a graphics system in which the present invention can be implemented. System 700 includes central processing unit (CPU) 710, random access memory (RAM) 720, read only memory (ROM) 725, one or more peripherals 730, graphics controller 760, primary storage devices 740 and 750, and digital display unit 770. CPUs 710 are also coupled to one or more input/output devices 790 that may include, but are not limited to, devices such as, track balls, mice, keyboards, microphones, touch-sensitive displays, transducer card readers, magnetic or paper tape readers, tablets, styluses, voice or handwriting recognizers, or other well-known input devices such as, of course, other computers. Graphics controller 760 generates image data and a corresponding reference signal, and provides both to digital display unit 770. The image data can be generated, for example, based on pixel data received from CPU 710 or from an external encode (not shown). In one embodiment, the image data is provided in RGB format and the reference signal includes the $V_{SYNC}$ and $H_{SYNC}$ signals well known in the art. However, it should be understood that the present invention can be implemented with image, data and/or reference signals in other formats. For example, image data can include video signal data also with a corresponding time reference signal.

Although only a few embodiments of the present invention have been described, it should be understood that the present invention may be embodied in many other specific forms without departing from the spirit or the scope of the present invention. The present examples are to be considered as illustrative and not restrictive, and the invention is not to be limited to the details given herein, but may be modified within the scope of the appended claims along with their full scope of equivalents.

While this invention has been described in terms of a preferred embodiment, there are alterations, permutations, and equivalents that fall within the scope of this invention. It should also be noted that there are many alternative ways of implementing both the process and apparatus of the present invention. It is therefore intended that the invention be interpreted as including all such alterations, permutations, and equivalents as fall within the true spirit and scope of the present invention.

What is claimed is:

1. A method of providing sticky pixel LC overdrive to a pixel to be displayed at a target pixel value in a current video frame n when the pixel has a corresponding pixel value transition that crosses a sticky pixel threshold boundary corresponding to a sticky pixel region during the current video frame n, comprising:

changing a starting pixel value at the current video frame n by applying a pre-tilt pixel value to the pixel during an immediately previous video frame n−1 such that the changed starting value reduces an amount of time that the pixel spends in the sticky pixel region during the pixel value transition in the current frame n thereby allowing the pixel to reach the target pixel value within a period of time corresponding to the current frame n; and displaying the overdriven pixel at the target pixel value during the current frame n.

2. The method as recited in claim 1, wherein the current video frame n, and the immediately previous video frame n−1 are each formed of a number of pixels each having an associated pixel value.

3. The method as recited in claim 2, wherein the pixels are each associated with a pixel data word PD.

4. The method as recited in claim 3, further comprising:

at a concatentator unit, receiving an m bit pixel data word PDm corresponding to a pixel associated with the immediately previous frame n−1 that is currently being displayed;

receiving an n bit pixel data word PDn corresponding to the pixel to be displayed in the current frame;

concatenating the m bit pixel data word PDm and the n bit pixel data word PDn.

5. A method as recited in claim 4, further comprising:

storing the concatenated pixel data word in a frame buffer;

comparing the concatenated pixel data word to a sticky region threshold value;

setting a sticky region indicator based upon the comparing; and applying the sticky pixel overdrive to the pixel when the sticky region indicator is set.

6. An apparatus for providing sticky pixel LC overdrive to a pixel to be displayed at a target pixel value in a current video frame n when the pixel has a corresponding pixel value transition that crosses a sticky pixel threshold boundary corresponding to a sticky pixel region during the current video frame n, comprising:

means for changing a starting pixel value at the current video frame n by applying a pre-tilt pixel value to the pixel during an immediately previous video frame n−1 such that the changed starting value reduces an amount of time that the pixel spends in the sticky pixel region during the pixel value transition in the current frame n thereby allowing the pixel to reach the target pixel value within a period of time corresponding to the current frame n; and means for displaying the overdriven pixel at the target pixel value during the current frame n.

7. The apparatus as recited in claim 6, wherein the current video frame n, and the immediately previous video frame n−1 are each formed of a number of pixels each having an associated pixel value.

8. The apparatus as recited in claim 7, wherein the pixels are each associated with a pixel data word PD.

9. The apparatus as recited in claim 8, further comprising:

means for receiving an m bit pixel data word PDm corresponding to a pixel associated with the immediately previous frame n−1 that is currently being displayed;

means for receiving an n bit pixel data word PDn corresponding to the pixel to be displayed in the current frame; and means for concatenating the m bit pixel data word PDm and the n bit pixel data word PDn.

10. The apparatus as recited in claim 9, further comprising:

means for storing the concatenated pixel data word in a frame buffer;

means for comparing the concatenated pixel data word to a sticky region threshold value;

means for setting a sticky region indicator based upon the comparing; and means for applying the sticky pixel overdrive to the pixel when the sticky region indicator is set.

11. Computer executable instructions encoded in computer readable medium for providing sticky pixel LC overdrive to a pixel to be displayed at a target pixel value in a current video frame n when the pixel has a corresponding pixel value transition that crosses a sticky pixel threshold boundary corresponding to a sticky pixel region during the current video frame n, comprising:

computer code for changing a starting pixel value at the current video frame n by applying a pre-tilt pixel value to the pixel during an immediately previous video frame n−1 such that the changed starting value reduces an amount of time that the pixel spends in the sticky pixel region during the pixel value transition in the current frame n thereby allowing the pixel to reach the target pixel value within a period of time corresponding to the current frame n; and computer code for displaying the overdriven pixel at the target pixel value during the current frame n.

12. The computer executable instructions as recited in claim 6, wherein the current video frame n, and the immediately previous video frame n−1 are each formed of a number of pixels each having an associated pixel value.

13. The computer executable instructions as recited in claim 7, wherein the pixels are each associated with a pixel data word PD.

14. The computer executable instructions as recited in claim 8, further comprising:

computer code for receiving an m bit pixel data word PDm corresponding to a pixel associated with the immediately previous frame n−1 that is currently being displayed;

computer code for receiving an n bit pixel data word PDn corresponding to the pixel to be displayed in the current frame; and computer code for concatenating the m bit pixel data word PDm and the n bit pixel data word PDn.

15. The computer executable instructions as recited in claim 9, further comprising:

computer code for storing the concatenated pixel data word in a frame buffer;

computer code for comparing the concatenated pixel data word to a sticky region threshold value;

computer code for setting a sticky region indicator based upon the comparing; and computer code for applying the sticky pixel overdrive to the pixel when the sticky region indicator is set.

* * * * *